United States Patent [19]

Vu et al.

[11] Patent Number: 4,893,359

[45] Date of Patent: Jan. 16, 1990

[54] VENTED TOILET BOWL

[76] Inventors: Phuc N. Vu, 4451 Janssen Dr., Memphis, Tenn. 38128; George Spector, 233 Broadway, Rm 3815, New York, N.Y. 10007

[21] Appl. No.: 311,742

[22] Filed: Feb. 17, 1989

[51] Int. Cl.[4] ..... E03D 9/05

[52] U.S. Cl. ..... 4/216

[58] Field of Search ..... 4/213, 216, 217, 348–352

[56] References Cited

U.S. PATENT DOCUMENTS

| | | | |
|---|---|---|---|
| 1,247,176 | 11/1917 | Swarzman | 4/217 |
| 1,911,032 | 5/1933 | Minkler | 4/217 X |
| 1,998,657 | 4/1935 | De La Croix | 4/213 |
| 2,516,476 | 7/1950 | Mitton | 4/216 |
| 2,818,582 | 1/1958 | Rosselle | 4/213 |
| 2,846,696 | 8/1958 | Merriott | 4/213 |
| 3,533,112 | 10/1970 | Poister | 4/217 |

*Primary Examiner*—Charles E. Phillips

[57] ABSTRACT

An odor eliminator system for a toilet bowl is provided that is hidden from view by being built into the toilet bowl and includes an exhaust fan activated by a switch in the bathroom wall. In a modification the exhaust fan in the bathroom wall is activated by a button switch built into the toilet seat when a person sits upon the seat.

7 Claims, 1 Drawing Sheet

VENTED TOILET BOWL

BACKGROUND OF THE INVENTION

The instant invention relates generally to apparatuses for removing objectionable odors from toilet bowls and more specifically it relates to an odor eliminator system for a toilet bowl.

Numerous apparatus for removing objectionable odors from toilet bowls have been provided in prior art that are adapted to be separate structures removably attached to the toilet bowls. For example, U.S. Pat. Nos. 4,117,559; 4,175,293 and 4,200,940 all are illustrative of such prior art. While these units may be suitable for the particular purpose to which they address, they would not be as suitable for the purposes of the present invention as heretofore described.

SUMMARY OF THE INVENTION

A primary object of the present invention is to provide an odor eliminator system for a toilet bowl that will overcome the shortcomings of the prior art devices.

Another object is to provide an odor eliminator system for a toilet bowl that is hidden from view by being built into the toilet bowl with an exhaust fan activated by a switch in the bathroom wall.

An additional object is to provide an odor eliminator system for a toilet bowl in which the exhaust fan in the bathroom wall is activated by a pressure sensitive switch built into the toilet seat when a person sits upon the seat.

A further object is to provide an odor eliminator system for a toilet bowl that is simple and easy to use.

A still further object is to provide an odor eliminator system for a toilet bowl that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be madein the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
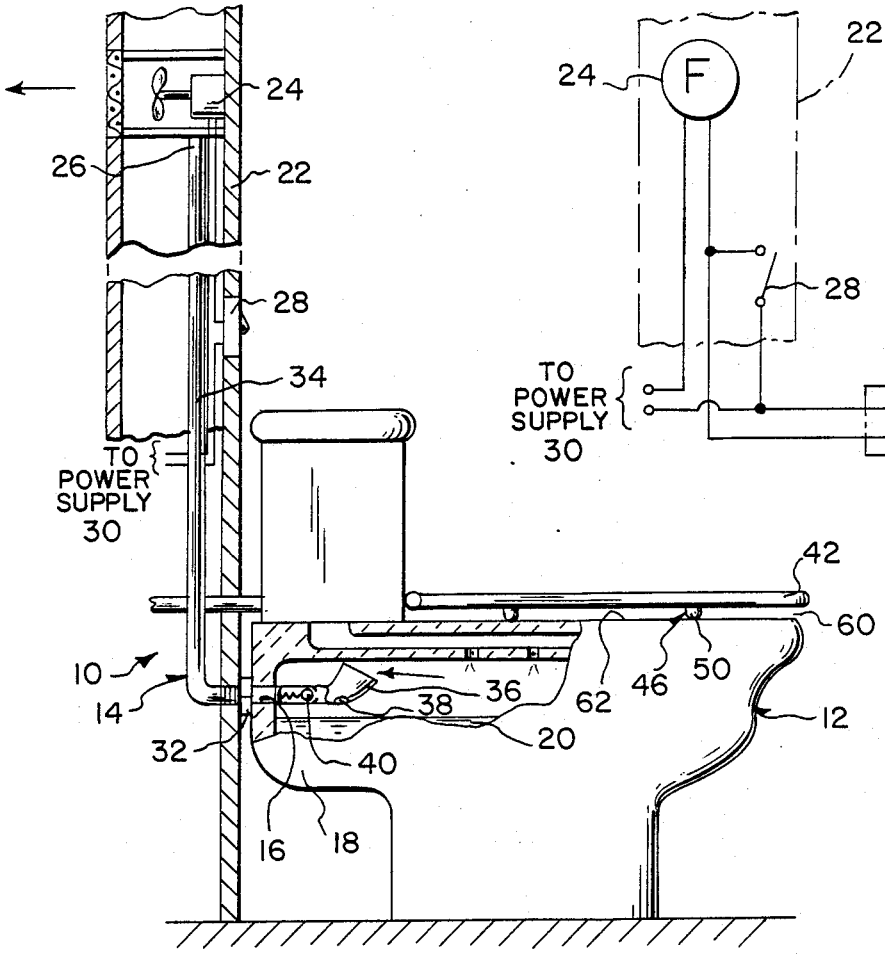
FIG. 1 is a side view with parts broken away and in section of the invention installed and ready for use with a toilet bowl.
Figure 4:
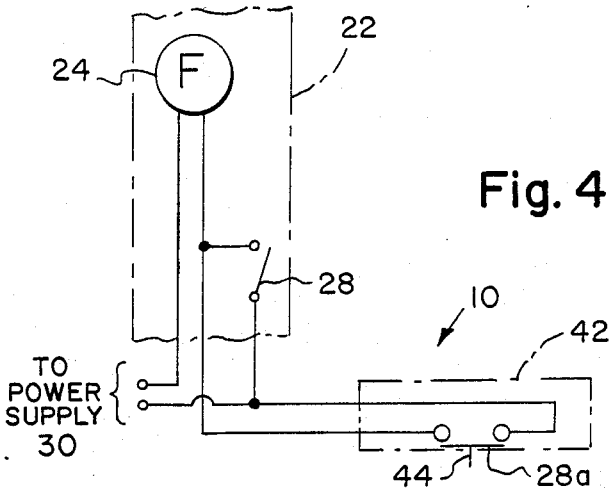
FIG. 4 is a schematic diagram of the electrical circuit showing the manual switch and toilet seat pressure sensitive switch in combination thereof.

Turning now descriptively to the drawings, in which similar reference characters denote similar elements throughout the several views, FIGS. 1 and 4 illustrate an odor eliminator system 10 for a toilet bowl 12 consisting of an elongated conduit 14 extending through an aperture 16 in rear portion 18 of the toilet bowl 12 above the water 20 and up into a bathroom wall 22. An exhaust fan 24 is built into the bathroom wall 22 and is connected to distal end 26 of the conduit 14. A switch 28 is electrically connected between the exhaust fan 24 and a power supply 30 so that when the switch 28 is closed the exhaust fan 24 will be activated for drawing gaseous odor away from the toilet bowl 12 and out into the ambient atmosphere.

The elongated conduit 14 includes a fitting 32 disposed into the aperture 16 in the rear portion 18 of the toilet bowl 12. A pipe 34 extends from one side of the fitting 32 to the exhaust fan 24. An outlet port member 36 extends from opposite side of the fitting 32 into the toilet bowl 12. The outlet port member 36 curves upwardly at free end thereof and has a drain hole 38 therein. A normally closed one way valve 40 is built into the outlet port member 36 to generally prevent some of the agitated water 20 within the toilet bowl 12 to enter the pipe 34, whereby the check valve 40 will only open when the exhaust fan 24 is activated.

The switch 28 shown in FIGS. 1 and 4 is located on the bathroom wall 22 and can be manually activated by a person using the toilet bowl 12.

The switch shown in FIGS. 2, 3, 4 and 5 is a pressure sensitive switch 28a and is built into a toilet seat 42 and can be activated by a person placing their weight upon the toilet seat 42. The pressure sensitive switch 28a has a button portion 44 extending downwardly therefrom. A flexible member 46 is disposed to underside 48 of the toilet seat 42 about the button portion 44 so that when the person places their weight upon the toilet seat 42 the flexible member 46 will compress causing the button portion 44 to activate the pressure sensitive switch **28*a***.

Figure 5:
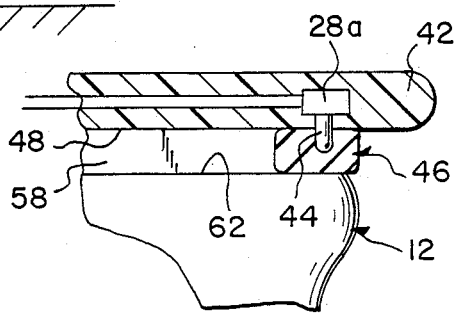
FIG. 5 is an enlarged side view broken away and in section showing the pressure sensitive switch in the toilet seat and a rubber gasket attached to underside of the toilet seat which will activate the button switch when a person sits upon the toilet seat and compresses the rubber gasket.
Figure 2:
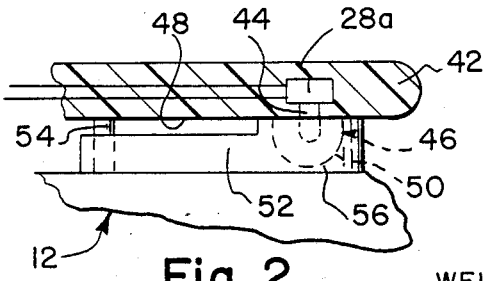
FIG. 2 is an enlarged side view broken away and partly in section of the toilet seat with a pressure sensitive switch therein connected to the fan and power supply and swivel lever to deactivate the pressure sensitive switch.
Figure 3:
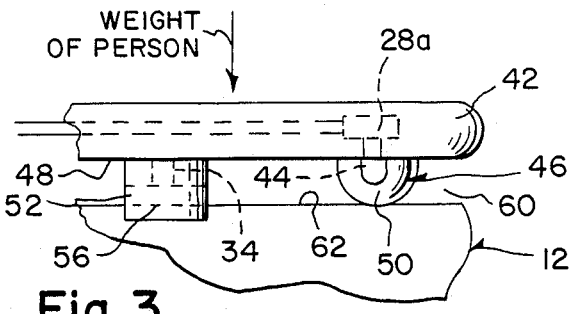
FIG. 3 is an enlarged side view broken away of the toilet seat on the bowl showing the pressure sensitive switch automatically activated to turn on the fan when a person sits upon the toilet seat.

The flexible member 46 shown in FIGS. 2 and 3 is a rubber foot 50. A swivel lever 52 is pivotly mounted at one end 54 to the underside 48 of the toilet seat 42. The swivel lever 52 has a free end portion of a cup 56 so that when the cup 56 is in engagement with the toilet seat 48 and bowl 12 it will prevent actuation of the pressure sensitive switch **28*a*. The flexible member 46 as shown in FIG. 5 is an O-shaped rubber gasket 58 extending about the underside 48 of the toilet seat 42 to eliminate air gap 60 between the toilet seat 42 and top 62 of the toilet bowl 12 so as to get better suction from the exhaust fan 24**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An odor eliminator system for a toilet bowl which comprises:

an elongated conduit extending through an aperture in a rear portion of the toilet bowl above the bowl water and upwardly into a bathroom wall;

an exhaust fan built into the bathroom wall and connected to a distant end of said conduit;

a switch electrically connected between said exhaust fan and a power supply to that when said switch is closed said exhaust fan will be activated for drawing gaseous odors away from the toilet bowl and out into the ambient atmosphere;

wherein said elongated conduit includes:

a fitting disposed into the aperture in the rear portion of the toilet bowl;

a pipe extending from one side of said fitting to said exhaust fan;

an outlet port member extending from the opposite side of said fitting into said toilet bowl, said outlet port member curving upwardly at a free end thereof and having a drain hole therein; and a normally closed one way check valve built into said outlet port member to generally prevent some of the agitated water within the toilet bowl from entering said pipe, whereby said check valve will only open when said exhaust fan is activated.

2. An odor eliminator system as recited in claim 1, wherein said switch is located on the bathroom wall and can be manually activated by a person using the toilet bowl.

3. An odor eliminator system as recited in claim 1, wherein said switch is a pressure sensitive switch and is built into a toilet seat and can be activated by a person placing their weight upon the toilet seat.

4. An odor eliminator system as recited in claim 3, further comprising:

(a) said pressure sensitive switch having a button portion extending downwardly therefrom; and (b) a flexible member disposed to underside of the toilet seat about said button portion so that when the person places their weight upon the toilet seat said flexible member will compress causing the button portion to activate said pressure sensitive switch.

5. An odor eliminator system as recited in claim 4, wherein said flexible member is a rubber foot.

6. An odor eliminator system as recited in claim 5, further comprising a swivel lever pivotly mounted at one end to the underside the toilet seat, said swivel lever having means to prevent switch actuation when a person sits on the seat.

7. An odor eliminator system as recited in claim 4, wherein said flexible member is an O-shaped rubber gasket extending about the underside of the toilet seat to eliminate air gap between the toilet seat and top 62 of the toilet bowl 12 so as to get better suction from said exhaust fan.

* * * * *